US009180726B2

(12) United States Patent
Chevallier et al.

(10) Patent No.: US 9,180,726 B2
(45) Date of Patent: Nov. 10, 2015

(54) SHEET ARTICLE INTENDED TO BE APPLIED TO A WALL TO BE DECORATED AND ASSOCIATED PRODUCTION METHOD AND APPLICATION METHOD

(75) Inventors: Stanislas Chevallier, La Celle Saint-Cloud (FR); Wilfrid Sourbe, Bordeaux (FR); Héléna Cheminet, Gradignan (FR); Vincent Delsuc, Talence (FR); Jérôme De Dinechin, Versailles (FR)

(73) Assignees: CORSO MAGENTA, La Celle Saint-Cloud (FR); CHEVALLIER, STANISLAS, La Celle Saint-Cloud (FR)

( * ) Notice: Subject to any disclaimer, the term of this patent is extended or adjusted under 35 U.S.C. 154(b) by 627 days.

(21) Appl. No.: 13/376,163

(22) PCT Filed: Jun. 3, 2010

(86) PCT No.: PCT/EP2010/057807

§ 371 (c)(1), (2), (4) Date: Feb. 23, 2012

(87) PCT Pub. No.: WO2010/139778

PCT Pub. Date: Dec. 9, 2010

(65) Prior Publication Data

US 2012/0141739 A1 Jun. 7, 2012

(30) Foreign Application Priority Data

Jun. 3, 2009 (FR) ..... 09 53657

(51) Int. Cl.
*B05D 5/10* (2006.01)
*B44C 1/10* (2006.01)

(52) U.S. Cl.
CPC ..... *B44C 1/105* (2013.01); *Y10T 428/24479* (2015.01); *Y10T 428/265* (2015.01); *Y10T 428/28* (2015.01); *Y10T 428/2848* (2015.01); *Y10T 442/3049* (2015.04); *Y10T 442/603* (2015.04)

(58) Field of Classification Search
CPC ..... B44C 1/105
USPC ..... 427/207.1, 208.2; 428/156, 343, 354
See application file for complete search history.

(56) References Cited

U.S. PATENT DOCUMENTS

| | | | | |
|---|---|---|---|---|
| 4,818,589 | A | 4/1989 | Johnson et al. | |
| 2002/0155243 | A1 * | 10/2002 | Kobe et al. | 428/40.1 |
| 2003/0134114 | A1 | 7/2003 | Pallotta et al. | |
| 2004/0161566 | A1 * | 8/2004 | Truog et al. | 428/40.1 |
| 2006/0009552 | A1 * | 1/2006 | Husemann et al. | 524/80 |

FOREIGN PATENT DOCUMENTS

| | | |
|---|---|---|
| DE | 37 23 345 | 1/1989 |
| DE | 10 2007 016 794 | 10/2008 |
| EP | 0 987 102 | 3/2000 |
| WO | WO 98/17855 | 4/1998 |
| WO | WO 2005/044558 | 5/2005 |

* cited by examiner

*Primary Examiner* — Xiao Zhao
(74) *Attorney, Agent, or Firm* — Blakely Sokoloff Taylor & Zafman LLP

(57) ABSTRACT

The invention relates to a sheet article (1) intended for the application of decorative layers to walls (50) to be decorated, characterised in that it comprises: a substrate (40) formed by an activatable adhesive film; and a layer (20) of material to be painted, disposed on a first face of the substrate (40), said adhesive being temporarily inactive and the second face of the substrate (40) being free.

11 Claims, 1 Drawing Sheet

SHEET ARTICLE INTENDED TO BE APPLIED TO A WALL TO BE DECORATED AND ASSOCIATED PRODUCTION METHOD AND APPLICATION METHOD

This is a non-provisional application claiming the benefit of International Application Number PCT/EP2010/057807, filed Jun. 3, 2010.

The present invention relates, generally speaking, to techniques of transposing or transferring decorative layers.

Numerous techniques are already known for transposing a decorative layer, by dry or wet process.

Conventionally, the wet process is the wall paper or decalcomania technique, whereas the dry process involves the use of a pressure sensitive adhesive layer, preserved until use by a peelable film.

In general, these known techniques imply that the decorative layer itself is on a substrate having a certain thickness, which has the effect, in general desired, of glossing over inequalities of the surface that receives the decorative layer.

Furthermore, the document WO-A-2006/084865, teaches decorative layer transposition techniques targeting a result that is visually like that obtained by a conventional painting technique, and which moreover may be implemented in an economic, simple and non soiling manner. One of these techniques employs a first temporary substrate on which a film of material to be painted is applied directly, with limited adhesion forces.

The film being dry, a first adhesive, which can be deactivated with water, is applied thereto then against the film a second thin temporary substrate with high deformability and partially absorbent is applied. This first adhesive creates between the film and said second temporary substrate adhesion forces greater than those existing between the film and the first temporary substrate.

After a sufficient drying of the first adhesive, the assembly formed by the second temporary substrate and the film are peeled off by separating them from the first temporary substrate.

The film retained is then bonded onto the second temporary substrate with a second adhesive, the assembly is applied against the definitive substrate, and after drying of the second adhesive, the second temporary substrate is dampened with water then the second temporary substrate is peeled off leaving the film of paint on the definitive substrate.

According to another of the techniques described in this document, an assembly is prepared formed of a temporary substrate and a material to be painted directly applied on it with limited adhesion forces to form a film. After drying, an adhesive is applied on a definitive substrate and/or on the film such that, after application of the assembly on said definitive substrate and drying of the adhesive, the temporary substrate can be peeled off leaving the film on the definitive substrate.

According to another technique described in this document, a film of material to be painted is applied directly on a substrate able to pass in a printing machine, and the dry film is directly printed in this machine.

Furthermore, when the film of paint is a filler layer, the techniques of application of the layer on a wall are again different.

Generally speaking, a filler is a layer constituted of binders and mineral fillers, the role of which is to protect the wall on which it is applied, to isolate it and to improve the appearance thereof. It may moreover comprise pigments enabling it to be coloured and to give it a decorative appearance.

The filler may be prepared on site, typically on an application worksite from a powder, or in the factory in the form of paste. It is then applied onto the wall to rectify its surface irregularities (holes, fissures, etc.), smoothed and flattened using a float, then dried and sanded. The operation is generally repeated several times in order to obtain a high quality result.

This method of application of a filler is however long and difficult to implement, and this is especially true when it is wished that the external surface is aesthetic and durable, perfectly flat and smooth. Indeed, the quality of preparation of the background is essentially due to the perfect application of fillers.

Furthermore, the application of the filler releases volatile organic compounds (VOC) which are harmful for the environment.

The present invention aims to propose a sheet article for filler or for a layer to be decorated that is easy and rapid to apply onto a wall while having a high quality finish.

The invention also aims to propose a method for applying a sheet article onto walls to be decorated, as well as an associated article, in which the article is directly bonded against the wall without application of liquid adhesive and the implementation of which is clean.

The invention also relates to a method of repairing and masking joints between two adjoining sheet articles.

Another aim of the invention is to propose a sheet article having novel properties, such as surface texturing, the incorporation of decorative components, active or activatable, the capacity of heating, energy recovery, lighting, etc.

According to another aspect, the aim of the invention is to propose a sheet article for application of decorative layers, which can be optionally printed, onto any type of wall to be decorated, and that can be applied either temporarily or definitively on the wall.

According to yet another aspect, the invention relates to a sheet article limiting the quantity of VOC released during its application on a wall and later.

The invention moreover relates to methods for producing such a sheet article for application of decorative layers on walls, which are simple to implement and inexpensive.

To this end, according to a first aspect of the invention a sheet article is proposed for application of decorative layers on walls to be decorated, characterised in that it comprises:

- a substrate formed of a film of activatable adhesive material; and
- a layer of material to be painted, disposed on a first face of the substrate;

the adhesive being temporarily inactive, and the second face of the substrate (40) being free.

Such a sheet article thus no longer requires the use of a protective sheet against its adhesive part, the adhesive layer being temporarily inactive. Furthermore its storage is simple and its implementation clean and easy.

Activatable adhesive film is here taken to mean a film, the adhesion properties of which are modified in an essentially irreversible manner under the action of an environment factor of the film, without nevertheless excluding the presence of compounds making it possible to facilitate the disbonding of the sheet article after application.

Certain preferred but non limiting aspects of the article conforming to the invention are the following:

- the article moreover includes at least one additional layer formed of at least one layer selected from a group comprising: a decorative layer, a layer having determined physical and chemical properties, a conductive layer, a layer capable of reacting with the surrounding environment.

Such surface layers confer to the article aesthetic properties that are difficult to obtain according to conventional production techniques, and make it possible moreover to create an article having active or activatable layers according to the type of surface layers used.

More preferential aspects are as follows:

- the additional layer is a decorative surface layer comprising at least one component from the following group: a varnish, coloured, metallic, nacreous particles, microbeads, fluorescent particles, luminescent particles, retroreflective particles, said particles being able to be held in a binder;
- the additional layer is able to react with the medium to which it is exposed;
- the additional layer is able to react with air, with water or with light;
- the surface layer comprises at least one material from the following: a microtextured paint, a water-oil repellent medium, zeolites, antifungal agents, anti-fouling agents, biocides, decontamination agents;
- the article is protected by a temporary protective layer; thus, when the article is applied onto the wall and when the temporary protective layer is removed, peeled off or dissolved, the surface layer can be activated in contact with the surrounding environment.
- the article moreover comprises an intermediate layer disposed between the first face of the substrate and the layer of material to be painted;
- the intermediate layer comprises at least one material from the following group: a mechanical reinforcement material, a barrier forming material, an electrically conductive material, a ferromagnetic material.
- the intermediate layer is a conductive layer in a form selected from the following group: a perforated conductive sheet, a network of resistive wires, a conductive polymer, conductive particles dispersed in one of the layers of the article.

Thanks to the conductive layer, the article may be connected for example to a low voltage source, and components (light emitting diodes, active sensors, sound devices, etc.) supplied with power making it possible to diffuse for example heat, light, sound, electromagnetic waves, etc.

The conductive layer may also play the role of surface sensor by integrating flat or added photovoltaic components, presence sensors, heat sensors, etc.

This conductive layer may finally provide a role of protection against electromagnetic waves by playing a role of Faraday cage for example.

Finally, the intermediate layer may make it possible to retain a magnetised component (for example incorporation of ferromagnetic particles in a binder).

- the article moreover comprises two electrically insulating layers situated on either side of the conductive layer;
- one of the insulating layers is constituted of the substrate formed by an activatable adhesive film and the other insulating layer is constituted of an additional adhesive layer;
- the conductive layer includes fittings for its electrical connection with the exterior;
- the article moreover comprises thin sensor means with electrical output connected to the conductive layer;
- the intermediate layer is selected from the following group: a mechanical reinforcement layer, a barrier layer. Furthermore, the intermediate layer provides additional mechanical strength enabling the article to be self-supporting and not very fragile, even when the moulding substrate is removed;
- the intermediate layer is a layer forming a heat and/or acoustic barrier comprising at least one material from the following group: materials with low heat and/or acoustic conduction coefficient and low density porous materials;
- the intermediate layer is a layer forming a barrier to the migration of atoms, molecules or ions, comprising a material selected from: a synthetic material in continuous film or a fibrous woven or non woven material;
- the adhesive is able to be activated by an agent in the following group: heat, a liquid, a gas, a radiation, a vibration;
- the adhesive is activatable with heat, at least part of the heat being provided thanks to the conductive layer;
- the adhesive has a temporary activation mode and a definitive activation mode;
- the adhesive comprises one at least of the materials from the following group: copropylene, copolyamide, polypropylene, polyethylene, thermoplastic polyurethane (TPU), hot melt pressure sensitive adhesive (HMPSA), polyethylene vinyl acetate (EVA);
- the adhesive comprises at least one additive forming a functional agent belonging to the group of opacifying agents, gelifying agents and blocking agents;
- the additive is selected from the following group: pyrogenic silica, titanium dioxide, talc;
- the layer of material to be painted includes at least one of the following layers: a layer of paint, a layer of varnish.
- the layer of material to be painted includes at least two layers of different colours.

The aesthetic rendering of the article is thus improved by virtue of the superposition of layers of paint, varnish, etc. having different colours.

- the article includes moreover a moulding substrate in contact with the layer of material to be painted, opposite the substrate formed of the adhesive.

The use of such a substrate makes it possible to adjust and control the quality of the finish of the visible surface of the article while ensuring a facility of demoulding.

- the moulding substrate is made of a solid or porous material selected from the following group: polyethylene terephthalate, polyethylenes with additives, siliconised papers, papers coated with a mould release agent, woven and non-woven fibres covered with a film-forming agent with low surface energy, silicones, Teflon.
- the face of the moulding substrate in contact with the layer of material to be painted has a controlled surface condition and surface energy;
- said face of the moulding substrate has reliefs;
- the thickness of the layers of material to be painted and adhesive material, and if appropriate the surface layer(s) and the intermediate layer(s), is comprised between 50 and 200 micrometres.

According to a second aspect, the invention relates to a first method of producing a sheet article according to the invention, comprising the steps consisting in:

(i) feeding a machine with a moulding substrate;

(ii) applying on a first face of the moulding substrate a layer of material to be painted;

(iii) drying the layer of material to be painted;

(iv) applying a layer of an adhesive activatable; and (v) drying the adhesive layer without activating it.

Certain preferred but non limiting aspects of the first method according to the invention are the following:

- the adhesive layer is formed of a thermo-activatable adhesive, and where the steps (iv) and (v) are implemented at a temperature below the activation temperature.

the drying is carried out cold and/or by vacuum.

the adhesive layer is formed of a powdery and film-forming adhesive, and the application and drying temperature are above the temperature of formation of the film, but below the activation temperature.

the method moreover comprises a step of adjustment by abrasion of the first face of the moulding substrate.

the method moreover comprises a step of adjustment of the surface energy of the first face of the moulding substrate so as to adapt its degree of adherence.

the adjustment of the surface energy is carried out according to one of the techniques comprised in the following group: ionisation, treatment by plasma gun, corona treatment.

the method moreover comprises a step of preparing the first face of the moulding substrate by machining or by moulding.

the method moreover comprises, subsequent to the step (v), the following steps:

separating the moulding substrate from the article; and printing the free surface of the article that is opposite to the adhesive layer in a printing machine.

the method moreover comprises, subsequent to the step (v), the following steps:

separating the moulding substrate from the article; and applying a peelable substrate in place of the moulding substrate.

This replacement of the moulding substrate by a peelable substrate guarantees to the manufacturer that his client cannot use it in order to produce himself articles according to the invention. This moreover allows the manufacturer to use moulding substrates of better quality and to have a better finish since he can reuse it to produce other articles.

According to a third aspect, the invention relates to a second method of producing a sheet article according to the invention, comprising the steps consisting in:

(i) feeding a machine with a substrate formed by an activatable adhesive film;

(ii) applying on a first face of the substrate a layer of material to be painted; and (iii) drying the layer of material to be painted.

In this method, no moulding substrate is necessary for the production of the article, its role being played by the film of adhesive activatable.

Certain preferred but non limiting aspects of the method conforming to the invention are as follows:

the method moreover comprises a step of application of a moulding substrate on the free surface of the layer of material to be painted opposite to the substrate before the drying of the layer of material to be painted.

The application of this moulding substrate on the article makes it possible to adjust the finish of the visible surface of the article, conferring on it a smooth appearance, provided with patterns in relief, gloss, satin or matt according to the desired result.

Concerning the production of the moulding substrate, the major difficulty resides in the fact of having both the structuring of the mould, which will provide to the sheet article the desired reliefs, a particular surface condition, and the surface energy which must both be sufficiently high to enable a sufficient wettability, while enabling demoulding after drying. It should be noted that the surface energy to obtain depends on the chosen type of material to be painted, such as a paint or a filler. For example, a glycerophthalic paint will be much more adherent than an acrylic paint, and the filler must have a much lower surface energy if it is wished to be able to demould it easily.

It is known that materials such as siliconised fillers, based on Teflon or other surfaces with low surface energies are unsuitable for an application of paint or fresh mortar. Indeed, in this case, it would form fish eyes, areas where there is no adhesion, and which subsequently do not make it possible to obtain a satisfactory surface condition.

Furthermore, plastics of polypropylene, polyester, polyethylene, polyamide, polychloride type in the untreated state have a high wettability, but after drying, removal would be impossible and would tear off pieces of paint or filler.

Thus, it may be necessary just as well to reduce the surface energy of the moulding substrate as to increase it.

According to yet another aspect, the invention thus relates to a method of producing a moulding substrate for the implementation of a method conforming to the invention, comprising the following steps:

(i) defining a first material for the moulding substrate;

(ii) as a function of a sought after relief effect for the article and the nature of a second material to apply firstly on the moulding substrate, defining a target surface condition and surface energy for one face of a moulding substrate on which the article is intended to be formed, so as in particular to obtain a wettability by said material and a demouldable character of the article after drying; and (iii) treating a face of a sheet formed with said first material to obtain the target surface condition and surface energy, to obtain thereby the moulding substrate.

Certain preferred but non limiting aspects of this method are the following:

the first material is polyethylene terephthalate.

the thickness of the sheet is comprised between around 5 μm and 100 μm, and more specifically between around 36 and 50 μm.

to obtain the target surface condition, the step (iii) is implemented by abrasion.

the abrasion is a mechanical abrasion by sandblasting.

the abrasion combines a chemical attack and the application of a particulate material.

For example, in one embodiment, a sanding by means of ground sand is carried out for several seconds, or any other means of abrasion making it possible to obtain the desired appearance, such as the application of a chemical treatment using acids then a deposition of silica.

to obtain the target surface condition, the step (iii) is implemented by formation of hollows and/or reliefs with a technique selected from hot moulding and etching.

the hollows and/or reliefs have a mean geometric period comprised between around 5 and 200 μm.

to obtain the target surface energy, the step (iii) comprises a treatment selected from: a corona treatment and exposure to a plasma gun.

to obtain the target surface energy, the step (iii) comprises the application of a product that modifies the surface energy.

the product is a latex, so as to increase the surface energy.

the product is a substance with low intrinsic surface energy, so as to lower the surface energy.

Thus, if the surface energy is too low with respect to the desired result, for example for a mould with deep asperities, the surface energy is increased. On the other hand, if the surface energy is too high, the film of a thickness of several micrometres is coated with a product with low surface energy.

The moulding substrate is then able to be placed in contact with the material to be painted or a surface layer. At the end of drying, it will have given to the filler its surface appearance, and will be easy to peel off.

According to another aspect, the invention relates to a method of applying an article according to the invention to be decorated, characterised in that it comprises the steps consisting in:

setting off an activation phase of the substrate formed of the activatable adhesive material;

applying the face of the article comprising the adhesive film against the wall to be decorated;

pressing down the article against the wall during at least one part of the activation phase.

The application of the article according to the invention is thus simple, rapid and clean.

Certain preferred but non limiting aspects of the method are as follows:

the article moreover includes a surface layer protected by a protective film, and where the method moreover comprises a step of removal of the protective film; and the method moreover comprises a step of removal of the moulding substrate.

The moulding substrate may be used not only for producing the article that is the subject of the invention, but also to provide a means of repairing the articles and to mask the joints which could be noticed between two adjacent articles.

Similarly, in the event of damage to an already bonded article, a repair may be made by applying a material to be painted of formulation similar to that of the article and covering it with a piece of moulding substrate.

Thus according to yet another aspect, the invention relates to a method of finishing or repairing a decor obtained according to the method of the invention, comprising the following steps:

application of a material to be painted in liquid or paste form similar to that used to form the article on a zone to be finished or to be repaired;

before drying of the material to be painted, application of a moulding substrate similar to that used to form the article against said material to be painted in said zone; and after a drying period, removal of the moulding substrate.

In this way, the surface appearance will be as close as possible to the appearance of an article.

Other characteristics, aims and advantages will become clearer on reading the detailed description that follows, and with reference to the appended drawings given by way of non limiting examples and in which.

Figure 1:
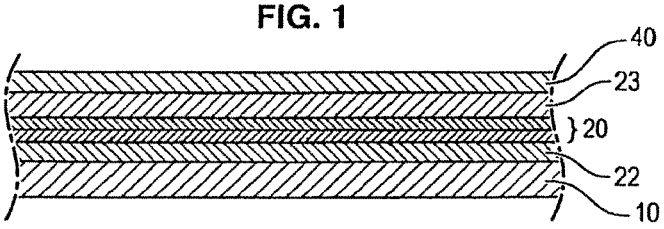
FIG. 1 is a sectional view of an embodiment of a sheet article for application of decorative layers on walls to be decorated according to the invention.

With reference firstly to FIG. 1, a sheet article 1 according to the invention may comprise a moulding substrate 10, a surface layer having aesthetic properties and/or particular physical and chemical properties 22, a layer of material to be painted 20, an intermediate layer 23, and an adhesive layer 40, all of these layers being able to be present or not as a function of the end result that it is wished to obtain.

In the present description, the term "complex" is taken to mean the assembly formed by the layers superimposed during steps of production that have already been described.

The Moulding Substrate

The moulding substrate 10 is adapted to ensure the mechanical cohesion of the article during the phases of production, optional printing and application, and to confer to the visible layer of article 1 the sought after surface finish.

On the moulding substrate 10, which may be flat or comprise relief patterns, is applied the rest of the complex forming the sheet article. It is preferably constituted of a sheet made of polyethylene terephthalate (PET), a degradable polyethylene with additives, a siliconised paper, a siliconised mould, or instead a machined mould (especially a Teflon plate, smooth or machined).

Typically, the moulding substrate has a thickness ranging from 10 μm to 500 μm, preferably from 26 μm to 100 μm, according to the composition of the material to be painted 20 used, its destination and its thickness, in order to facilitate the implementation, the conditioning and the storage of the article 1.

As will be seen hereafter, this substrate 10 may be primed to adapt the wettability thereof (and thus the surface energy) and/or the surface reliefs, such as on the one hand the layers deposited on its surface have an adapted cohesion to have a final uniform appearance following their drying, and on the other hand said layers 15 can be demoulded easily.

Said moulding substrate may be supplied alone and in a specific conditioning to enable the treatment of joints between articles or the repair of damaged articles.

The Layer of Material to be Painted 20

The layer of material to be painted 20 includes one or more layers of paint, varnish, or other, spread out on the substrate. The materials of the layers composing the material to be painted 20 may be identical or different, according to the desired effect. The superposition of layers in the layer of material to be painted 20 improves its opacity, its hiding power and may optionally modify the reaction of the material to external light as a function of its characteristics, i.e. whether the light is direct, indirect, strong, weak, etc.

The layer of material to be painted 20 may also play the role of an ionic barrier to protect the wall 50 or the surrounding environment. For example, when the wall to be decorated 50 includes lead, the application of the sheet article 1 according to the invention makes it possible to create a barrier preventing the migration of ions towards the surface, the layer of material to be painted being already dry during the application. The prior application of a specific protective layer thus becomes optional.

The paint used may be a mono- or multi- component paint of acrylic, polyurethane, glycerophthalic type or be specific to the type of wall to be decorated 50.

Typically, the quantity of material to be painted forming the layer of material to be painted 20 is situated in range extending from 50 to 150 g/m2.

The Adhesive Layer 40

The adhesive layer 40 includes an activatable adhesive, in other words a material provided with adhesive properties activatable by change of an exogenous parameter. For example, the adhesive may be thermo-activatable (activatable by input of heat when it is subjected to infrared or to an electromagnetic induction if a conductive layer is present), activatable with water, activatable by application of ultraviolet, activatable by pressure (especially by bursting of microcapsules present initially in the adhesive layer which then frees a material having hardening properties), sensitive to ultrasounds, or HMPSA, hot melt pressure sensitive adhesive.

Thus, the adhesive layer 40 may comprise one at least of the materials among which: copropylene, copolyamide, polypropylene, polyethylene, thermoplastic polyurethane (TPU), ethylene vinyl acetate (EVA), and resins generally used in the dental field.

This adhesive layer 40 may also be adapted to have mechanical strength properties such that the article is self-supporting. Thus, when the layer is formed by a film of adhesive, it can serve as substrate to the complex during the production phases.

Furthermore, in the case especially of an adhesive in liquid form, it is possible to increase its viscosity by adding to it thixotropic agents of the pyrogenic silica type, Aerosil®, etc. in order to improve the maintaining of the article on the substrate to be decorated 50.

Additional Layers

Optionally, the complex may comprise moreover one or more additional layers, conferring on it particular properties linked especially to the conditions of use of the article 1 according to the invention, the medium to which it is exposed, the type of wall 50, the functions that it can advantageously fulfil, etc.

Such additional layers are applied between the substrate 10 and the adhesive layer 40. More precisely, the additional layers 5 may be applied directly on the substrate 10, form part of the layers composing the layer of material to be painted 20 or over the layer of material to be painted.

The article may comprise a plurality of different additional layers spread out over its thickness.

The additional layers may be classified into two major categories: the layers applied between the substrate and the layer of material to be painted 20 named surface layers 22, and the layers mixed with the layer of material to be painted or between the material to be painted 20 and the adhesive 40, named intermediate layers 23.

According to a first embodiment, the additional layer is a surface layer 22 consisting of one or more among the following layers: a layer of varnish, a layer having a decorative appearance, a layer having particular physical and chemical properties.

The surface layer may be a varnish, preferably transparent, applied directly onto the moulding substrate 10 before the layer of material to be painted 20. For example, the layer of varnish may be a layer of acryl type, and serves as demoulding layer, especially when the adhesion characteristics of the decorative layer, in other words of the lower layer composing the layer of material to be painted 20, are too great to enable a clean removal of the substrate to be demoulded 10. The varnish may also provide a UV barrier function, or anti-graffiti functions. Examples of varnish that may be used are: alkyd resins in aqueous phase, polymers in aqueous phase, polyurethane resins in aqueous phase, urethane alkyds in solvent phase, or instead dispersions of acrylic resins in aqueous phase.

Alternatively, the additional layer applied against the layer of material to be painted 20 is a layer 22 adapted to have a particular appearance and/or physical and chemical properties.

Such a layer 22 is intended to be exposed visibly on the wall once the article 1 is applied on it. It may have a purely decorative role, and/or confer to the complex additional physical-chemical properties.

According to a first aspect, this layer 22 may be composed of coloured particles, of particles having a volume making it possible to confer to the decorative layer a given relief (especially glass microbeads of below 0.5 mm), etc. optionally mixed with a layer of translucent paint or varnish.

According to a second aspect, the decorative layer 22 may comprise components having particular physical and chemical properties conferring to the layer 22 a decorative appearance varying as a function of external conditions. They may be for example components that change appearance (colour, gloss, texture, etc.) as a function of the temperature, the light (such as fluorescent, luminescent, retro-reflective particles, etc.), the humidity, the presence of determined chemical or biological components.

For example, the layer 22 may be water-oil repellent and preserve the layer of material to be painted 20 from aggressions due to the penetration of water and/or greases: an article 1 having anti stain properties, anti graffiti, etc., is then obtained It may also have a hardness greater than the hardness of the layer of material to be painted 20, and increase the resistance of the complex to impacts and scratches.

According to another embodiment example, the additional layer 22 may be formed of a micro-structured paint adapted for example to the nautical sector, of the "shark skin" type or, in the aeronautic sector, comprising longitudinal grooves of a characteristic dimension of 25 micrometres.

According to another example, the additional layer may receive microgrooves conferring on it optical properties of lens or Fresnel mirror type.

According to a third aspect, the layer 22 may comprise components having determined physical and chemical properties having effects on the environment to which they are exposed (diffusion of biological or chemical substances for example).

Especially, these components may be adapted to react with volatile organic compounds (this is the case for example of zeolites or TiO2 in anatase form which, in the presence of light, has a catalytic effect on the destruction of VOC), may be antifungal agents, or instead antifouling agents adapted to protect the immersed surfaces of ships, etc.

These physical and chemical properties may moreover only be activated after removal of the substrate 10 (by contact with the surrounding environment) or disappearance of a protective layer (not represented) placed at the surface of said layer.

According to a second embodiment optionally complementary to the first, the additional layer is an intermediate layer 23 underlying the visible layer, and confers to the complex additional properties compared to known articles. This layer comprises one or more layers having physical and chemical properties, acting as barrier or reinforcement, a conductive layer.

For example, the layer 23 is formed of a heat insulating material, or having specific acoustic properties (absorption, dampening, reflection of sound waves) adapted for example to reduce the ambient noise. Such a material may be especially a polyurethane foam, a porous material of low density, or instead a resin in emulsion comprising a lightening filler and various adjuvants which, while drying, swell and become porous (see for example the product SEM-LIGHT distributed by the firm SEMIN).

Alternatively, the intermediate layer 23 is adapted so as to prevent the ionic migration of undesirable substances such as lead or any other toxic element. It may be constituted of a resin, which after polymerisation provides sealing, or by a film constituted of a material such as a polyethylene, a polyester, a polypropylene, a polystyrene. This film is treated to have a high surface energy, or is provided with a keying primer so that it adheres to the layers neighbouring it.

According to yet another alternative, the intermediate layer 23 is an armature adapted to reinforce the strength of the complex and render it optionally self-supporting, thereby making it possible to remove the substrate 10 after drying of the layers forming the article 1 in order to facilitate its storage.

Another advantage of this reinforcement layer 23 is to facilitate the use of the article 1 according to the invention in the case of renovations of old and deteriorated substrates.

The reinforcement layer 23 comprises for example a glass veil, a glass cloth, glass fibres and/or metallic or plant fibres, a plastic film, a non woven fabric, a textile or any other component making it possible to stiffen the layer of material to be painted 20 while conserving its adaptability to the wall 50 on which the article 1 is going to be bonded.

According to another embodiment, the intermediate layer is a conductive layer 23 (or optionally semi-conducting), and is in contact with the layer of material to be painted 20 or with the adhesive layer It may be held between two electrically insulating layers, the conductive layer may have patterns and designs making it possible to adjust its electrical parameters and to be connected to electrodes while avoiding any risk.

This conductive layer 23 may thus serve as substrate to calorific components such as electrical diodes, heat sensors or light sensors of photovoltaic type, etc., connected by means of cable terminals.

Such an article 1 may then be used in the recovery of energy or, quite the opposite, in the diffusion of energy by lighting or by heating.

It may have properties of sound diffusion, electromagnetic diffusion, protection by Farady cage effect, ferromagnetic properties making it possible to retain a magnetized component.

For example, the conductive layer 23 may be a layer of conductive paint, or comprise conductive components (tin oxides, metallic fibres optionally mixed with glass fibres, a network of resistive wires, a metallic sheet, etc.), a conductive polymer.

It may also be a laminate of fillers having photovoltaic properties, for example two respectively N and P doped semi-conducting layers and placed between two layers intended to collect the electrons emitted by the semi-conducting layers.

First Production Method

A first method will now be described making it possible to obtain a sheet article 1 for application of decorative layers according to the invention.

In a first step, the surface of the moulding substrate 10 is adjusted so as to confer to it a state of roughness adapted to the desired finish for the decorative layer that will be visible on the wall to be decorated. This step of adjustment may be implemented on a flat surface 25 or provided with patterns in relief of the moulding substrate 10.

In the case of a gloss finish, in other words a finish enabling a reflection similar to a mirror effect to be obtained (typically a specular gloss greater than 70 units measured under an angle of 60° according to the ISO 2813 standard), the moulding substrate 10 is optionally treated so as to reduce the roughness thereof. For example, for a substrate 10 of PET sheet type, the surface condition of the substrate being already sufficiently smooth in itself, no adjustment is necessary.

In the case of a satin or matt finish, the surface condition is adjusted by mechanical or chemical abrasion according to known abrasion techniques, for example by sandblasting or acid etching. The greater the abrasion carried out, the more the finish of the decorative layer obtained will be matt. This adjustment may also be carried out by spread coating.

In the case for example of abrasion by sandblasting, the nature of the sand used (rolled or ground), the pressure applied and the treatment time make it possible to adjust the degree of roughness, and thus the finish of the decorative layer. For example, it is possible to use sand based on corundum or glass beads.

This adjustment of the surface of the substrate makes it possible according to another application to obtain a micro-texturing of the surface, so as to achieve a moulding of a great finesse of the layer intended to be exposed to the exterior environment.

To do this, the moulding substrate 10 may be machined, or moulded, or thermoformed beforehand to give to it an exterior surface of the article having the desired properties.

For an application intended for ships, a coating is created similar to shark skin, the micro-perturbations of which facilitate hydrodynamic flow.

For an aeronautic application, longitudinal riblets are created with a characteristic dimension of 25 microns to reduce the vapour trail.

The micro-texturing may also create particular optical properties on the final exterior surface of the article 1. For example, the moulding on the surface of the moulding substrate of a Fresnel lens makes it possible to obtain at the end of the method, when the material to be painted is transparent, an article having the Fresnel lens property.

In another embodiment, if the material to be painted 20 or an additional layer 22 is a metallised surface, a Fresnel mirror is obtained.

Furthermore, according to the type of moulding substrate 10 used, the method moreover comprises a step during which the surface of the substrate 10 on which will be applied the first layer of the complex (in other words a surface layer 22 or the layer of material to be painted 20) is treated so as to adjust its surface energy, and thus its degree of adherence.

For example, in the case of a siliconised paper, the wettability of the substrate 10 is very low for a material to be painted of the glycerophthalic paint type, thereby creating surface irregularities, or even the appearance of bubbles during drying. It may thus prove to be necessary to treat the surface so as to increase its surface energy, for example by ionisation, corona treatment or plasma gun.

In a second step, optional, a surface layer, 22 is applied according to conventional techniques as a function of the type of layer on the moulding substrate 10 (especially by spraying, squeegee, with a roller, etc.).

For example, in the case of a layer of varnish, the layer is applied according to conventional material application methods, for example by heliography, screen printing, flexography, by spraying, if appropriate in combination with a squeegee or any other spread coating means.

It will be noted here that according to the application, the type of substrate and the type of varnish, the quantity applied may vary widely. The same variety of thicknesses will here be found as traditional techniques of applying materials to be painted such as varnishes and paints. The layer of varnish is then dried, preferably before the implementation of the following step.

In the case of an additional purely decorative layer 22, for example a layer of coloured particles, said particles are simply spread out in a random manner, or according to a predefined decorative scheme, on the surface of the substrate 10, and are immersed in a binder that may be a varnish 22 or directly the material to be painted 20.

In a third step, the material to be painted 20 is spread in one or more layers on the moulding substrate 10 or, if appropriate, on the surface layer 22 previously applied according to conventional techniques adapted to the type of material spread out.

The free surface through which the solvents and water evaporate is thus the surface which is intended to be hidden against the wall 50, unlike traditional methods in which it is the visible surface of the layer of material to be painted 20.

Yet, during drying, this evaporation creates irregularities in the free surface of evaporation, which makes necessary an additional finishing step (typically, a polishing of the surface when it is a filler) if a smooth, high quality finish is obtained.

Thus, by leaving to dry the layer on the substrate to be demoulded 10, the surface of the article that will be visible when it will be applied on the wall 20 is that which is in contact with the moulding substrate 10, and not the free surface through which escape the solvents. It is thus possible to control the appearance of the visible surface, without additional finishing step.

Advantageously, in the case where the layer of material to be painted 20 comprises at least two layers, preferably two layers having different colours are spread, so as to improve the rendering of the external layer which will be visible when the article 1 will be applied onto the wall 50. Indeed, monolayer (or multilayer and mono-colour) articles are not suitable for all lighting, and are substantially less aesthetic than multilayer and multi-colour paints.

For example, the application of an undercoat of red paint under a layer of blue paint makes it possible to obtain in the end a brighter blue.

Each layer composing the layer of material to be painted 20 is dried as work proceeds, for example in a thermal oven or in a dry air dryer.

When the article 1 includes an intermediate layer 23, this may be produced at any moment during the production method.

In the case of an intermediate layer having a mechanical reinforcement and/or barrier effect in the form of a film, this film is treated to enable an adhesion on a first adhesive layer, and its application is followed by the application of a second adhesive layer.

In the case of a conductive layer 23, this is formed over the layer of material to be painted 20, or within the layer of material to be painted 20 (between two layers of paint for example).

It may be applied either as a powder, or in the form of a perforated conductive sheet or finally in the form of a network or fabric of conductive or resistive wires, in the form of a conductive polymer.

In the first alternative, and when the adhesive layer 40 is also in powdery form, the conductive particles composing the conductive powder are mixed with the powder of adhesive, then the mixture is applied onto the layer of material to be painted 20.

Preferably, the material composing the powder of adhesive is film-forming.

The complex formed of the substrate 10, optional additional layers 22, 23, of the layer of material to be painted 20, conductive particles of the conductive layer 23 and particles of the adhesive layer 40 is then heated up to attain a sufficient temperature to melt the film-forming powder adhesive, which, on cooling, forms an adhesive layer in which are enclosed the conductive particles of the conductive layer 23.

In the second alternative, a first adhesive layer 40 is applied on the layer of material to be painted, followed by the conductive sheet 23 and a second adhesive layer 40. The complex is then heated until the layers of adhesive 40 melt and enclose the conductive layer 23. Typically, the adhesive used in this embodiment may be powdery or in the form of a film.

Finally, in a final step, when no conductive layer 23 is applied, or following the application of a conductive layer according to any of the above mentioned alternatives, a layer of adhesive 40 is applied over the complex obtained according to conventional application techniques, for example heliography, screen printing, flexography, by spraying, if appropriate in combination with a squeegee or any other spread coating means, then dried.

This film adhesive may be textured at the level of its back intended to come against the definitive substrate, which has the advantage of adhering less at the moment of the first application onto the definitive substrate, and to facilitate the removal of bubbles while pressing down.

Typically, the adhesive layer 40 is conditioned in film or in powdery form.

In the case of a thermo-activatable adhesive film of thermoplastic type, more particularly based on poly-EVA (ethylene vinyl acetate), typically of the commercially available Collano 20.600 type or the complex is heated until reaching the melting temperature of the adhesive, for example in an oven. Typically, the melting temperature of the adhesive is comprised between around 50° C. and around 150° C.

A complex is then obtained comprising an inactive thermo-activatable adhesive layer which adheres perfectly to the rest of the complex, but the free surface of which is dry and does not stick.

To render adherent the free surface of the inactive adhesive, it is necessary to heat it above a determined temperature in order to activate it.

Typically, for the thermo-activatable film Collano 20.301 based on EVA, the activation temperature of the adhesive layer is around 90° C. to 105° C. This temperature enables a temporary bonding, and the later application of a same temperature makes it possible if desired to remove the article 1 from the wall 50 and even to re-bond it on a new wall.

Alternatively, in the case of an adhesive layer applied from a powdery film-forming material, the powder is applied onto the layer of material to be painted then heated until it melts, so as to form an inactive adhesive film that does not stick. To be able to bond the article 10 to the wall, it is necessary to activate the adhesive layer by input of heat.

Certain adhesives contain moreover components that have a definitive activation by application of a first condition, typically heat.

In this case, the production of the adhesive layer 40 on the article 1 must make it possible to produce a film of adhesive or at least to fix onto the layer 20 a sufficient density of adhesive particles, but must not exceed, either during application or during drying, the activation temperature of this adhesive.

Finally, certain adhesives may comprise a material that decomposes in a range of temperature even above the activation temperature. At this temperature, the decomposition of the material creates a rupture in the adhesive, and makes it possible to remove easily the article, whereas the adhesive was formulated to be definitive.

Finally the following hierarchy is obtained by increasing temperatures:

- a temperature TO below which the adhesive is inactive;
- a range of temperatures T1 to T2 in which the adhesive may be activated in a temporary manner;
- a range of temperatures T3 to T4 in which the adhesive may be 30 activated in a definitive manner;
- a temperature T5 above which the adhesive is destroyed without the article or the substrate being deteriorated.

The choice of the adhesive layer applied onto the complex thus makes it possible to obtain an article having an inactive adhesive layer and which can be bonded either temporarily, or definitively or finally detached by destruction of the adhesive layer by adjusting the activation parameters of said layer.

For example, in the case of a polyester/polyurethane based adhesive such as an adhesive known under the trade name Collano HCM 555, the powder is deposited at ambient temperature then fixed on the complex at a maximum temperature of 65° C. The layer produced is then inert under the temperature T0 of 50° C.; it becomes thermo-activatable between the temperatures T1=65° C. and T2=95° C. It is activated in a definitive manner (thermosetting material) at a temperature comprised between T3=120 and T4=140° C. There is no temperature T5 for this adhesive.

A sheet article 1 according to the invention is thus obtained that can be bonded definitively to a wall 50.

This sheet article 1 may be left as is or undergo optional ulterior operations.

When, after the heating and cooling of the adhesive layer 40, the film formed is self-supporting, it is possible to remove the moulding substrate 10.

This enables for example the printing of the external layer of the article that was in contact with the substrate 10.

This also enables the recovery of the moulding substrate 10 and its optional replacement by a siliconised paper, a biodegradable substrate or any other peelable substrate. The manufacturer can thus allow himself to use a moulding substrate 10 of better quality in so far as it may be reused. This also enables the recovery of the moulding substrate 10 and its optional replacement by a siliconised paper, a biodegradable substrate or any other peelable substrate. The manufacturer can thus allow himself to use a moulding substrate 10 of better quality in so far as it may be reused. Furthermore, the optional biodegradability of the peelable substrate 30 makes it possible, in addition to respecting the environment, to guarantee that the client will not try to reuse the substrate in order to reproduce himself the sheet article 1 according to the invention.

After the different steps of application and drying, the sheet article 1 may be cut according to needs and conditioned in the form of panels or rolls, tapes, repair patches.

Application of the Article

Figure 3:
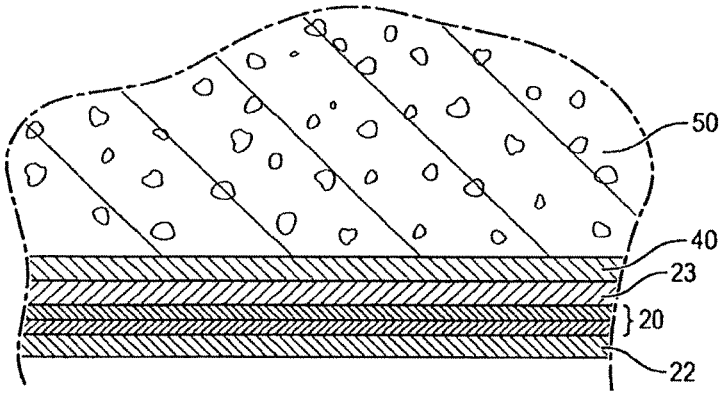
FIG. 3 is a sectional view of a wall to be decorated on which the sheet article of FIG. 1 or 2 has been applied.

The steps of applying the sheet article 1 on a wall or other substrate 50 to be decorated to obtain the decorated wall represented in FIG. 3 will now be described. The example will be taken of a sheet article 1 provided with the moulding substrate 10, a surface layer 22, a layer of material to be painted 20, an intermediate layer 23 and an adhesive layer 40.

It will be noted that the application can be carried out on extremely varied substrates (walls, joinery, furniture, etc.), made of also varied materials, having flat or curved faces (but preferably regular surfaces) and which can have surface defects according to the following process:

- activation of the adhesive layer 40;
- application of the activated adhesive layer 40 against the wall to be decorated 50;
- as of the end of the activation and according to the wishes of the user (or the technical constraints), removal of the moulding substrate 10, to thereby leave on the wall 50 the complex formed (in going from the wall to the exterior) by the adhesive layer 40, the intermediate layer 23, the layer of material to be painted 20 and the surface layer 22.

According to the type of activatable adhesive used, the step 1 of activation of the adhesive layer 40 is carried out by application of heat in the form of infrared or induction when a conductive layer is present, water, ultraviolet, ultrasounds or by pressure on the layer.

In the case where the adhesive layer 40 stems from a thermo-activatable film, a heat source of the paint burner type with or without steam provided with a temperature regulator, or of the ironing type may be used.

In the case of thermo-activatable films of the Collano 20.600 and 20.300 type for example, the activation temperature is around 90° C. to 115° C.

Advantageously, when the bonding of the article needs to be temporary, in other words when the article 1 must be able to be disbonded following its drying, or even following its prolonged application on the wall 50, the adhesion of the article 1 on the wall 50 is adjusted by heating the article in the lowest temperatures of the application range.

More precisely, the higher the activation temperature of the adhesive 40, the stronger the bonding of the article 1 and the more difficult it is to remove.

It may then be necessary for example to re-apply heat to the article 1 in order to disbond it On the other hand, if the activation temperature is low (while remaining sufficient to activate the adhesive), the article 1 may be disbonded cold by simple manual peeling.

In the case of a thermosetting curing adhesive, of Collano HCM 555 type, the adhesive layer 40 is heat activated by application of a temperature comprised between 120 and 140° C. The final adhesion is reached approximately after 24 h, and the bonding is then definitive.

According to another alternative, when the article 1 includes a conductive layer 23, the adhesive layer 40 is heated by means of an induction plate.

A wall 50 is then obtained comprising successively an adhesive layer 40, a conductive layer 23, a layer of material to be painted 20 and optionally one or more additional layers 22, the visible external surface of which does not require any additional finishing step.

Indeed, as has already been mentioned, the visible surface of the article 1 corresponds to the surface that was in contact with the moulding substrate 10, and thus exhibits a good quality appearance.

For example, if the moulding substrate 10 of the article 1 which is applied onto the wall 50 is a smooth PET substrate, the visible surface of the article 1 is also flat and smooth, giving a gloss finish.

If on the other hand the substrate 10 has been treated by mechanical or chemical abrasion, the visible surface of the article 1 will also be smooth but with a satin or matt appearance.

In all cases, no finishing step is necessary to obtain a high quality surface, which reduces both the difficulty of the application of the material to be painted and the necessary labour, while providing an easily reproducible quality result.

According to the surface of the wall to be decorated 50 and the dimensions of the sheet article 1, a single article 1 according to the invention may prove to be insufficient to cover the totality of the surface of the wall. It then suffices to place side by side several articles 1 in an adjacent manner not leaving any space between them.

The resulting joint may again be rendered invisible by the localised application of a material to be painted, covered with a tape formed in an identical or similar manner to the moulding substrate.

Advantageously, the joint is covered with a tape conditioned from the sheet article, which is applied after removal of the temporary substrate 10. The tape is activated and applied on the joint, the low residual thickness making the joint virtually invisible.

Second Production Method

Figure 2:
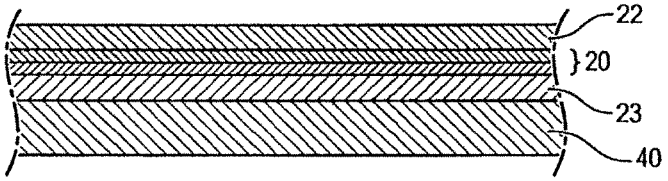
FIG. 2 is a sectional view of a second embodiment of a sheet article for application of decorative layers on walls to be decorated according to the invention.

A second production method will now be described with reference with FIG. 2.

Components common with the first embodiment method will not be detailed further.

This second method is more adapted to the production of a self-supporting article for which the moulding substrate 10 is not necessary.

A sheet article 1 obtained according to this second method thus comprises a substrate layer 40 formed of an adhesive film, a layer of material to be painted 20, and optionally one or more additional layers 22, 23.

The adhesive layer 40 is here an adhesive film in the form of already constituted thermoplastic film, for example of the Collano 20.600 or 20.300 type. Being self-supporting, this layer 40 serves as substrate for the rest of the complex.

Thus, according to a first production step, the machine is fed with an adhesive film 40, activatable for example with heat.

At least one layer of material to be painted 20 is then applied on the adhesive layer 40.

In the case where the layer of material to be painted 20 is a laminate comprising a plurality of layers, the visible layers of the layer of material to be painted are preferably of different colours in order to improve the final rendering.

If appropriate, one or more additional layers 22, 23 are applied in a similar but reverse manner to that which has been described for the first method, prior to the layer of material to be painted 20, simultaneously or consecutively for the layer intended to be visible 22.

When the conductive layer 23 is a powder, this is mixed with one of the layers of material to be painted 20, or is applied on the adhesive layer 40, prior to the layer of material to be painted 20, so as to ensure its adhesion with the rest of the complex.

The conductive layer 23 may also be applied on the adhesive layer 40 serving as substrate, then covered with a new adhesive layer 40, either in the form of film, or in powdery form, as we have described for the first production method.

The sheet article 1 thereby obtained is thus self-supporting and does not require the application of a temporary substrate in order to condition it, store it or to use it. The presence of the activatable adhesive film 40 solidifies it in fact sufficiently, and the specific use of a layer of an activatable (temporarily inactive) film 5 of adhesive enables it to do without the protective layer.

Once again, the sheet article 1 may be left as is or optionally undergo additional operations, such as the printing of the free surface of the material to be painted (or if appropriate the free surface of the complex when this includes one or more surface layers 22 disposed over the layer of material to be painted) in a conventional printing machine.

According to an embodiment, a moulding substrate 10 having a determined surface finish (smooth or provided with relief patterns, or even microtextured, and the surface energy of which has been optionally adjusted according to the first method) is applied on the free surface of the layer of material to be painted 20 (or, if appropriate, on the free surface of the surface layer 22) before it is dried in order to obtain a sheet article 1 comprising a visible external surface having a determined appearance 20.

The moulding substrate 1 may then be removed before storage of the article 1, or maintained in place up to the application on the wall 50.

Once again, the article 1 obtained according to this production method may be conditioned in rolls or in the form of flat sheets.

The application of this sheet article 1 is similar to the application of the previously described articles, with the exception of the fact that there is no moulding substrate 10 to remove. It suffices to activate the substrate layer of adhesive, for example with heat when it is a thermo-activatable adhesive, then to apply the complex against the surface of the wall to be decorated 50.

Finally, a protective sheet of the parchment paper type may be positioned on the article in the case where the activation by heat of the adhesive is then carried out by induction.

Obviously, the present invention is not at all limited to the embodiments described above and represented in the drawings, but those skilled in the art will know how to make numerous alternatives and modifications.

It is especially possible to combine the teachings relative to the different components of the articles and methods that have been described herein without going beyond the general scope of the invention.

The invention claimed is:

1. Method for producing a sheet article for application of decorative layers on walls to be decorated, said method comprising:

(i) feeding a machine with a moulding substrate;

(ii) applying on a first face of the moulding substrate a layer of material to be painted;

(iii) drying the layer of material to be painted;

(iv) applying a layer of an activatable adhesive;

(v) drying the adhesive layer without activating it;

(vi) separating the moulding substrate from the assembly of the paint material layer and the activatable adhesive; and (vii) performing again the method with the moulding substrate separated at step (vi).

2. Method according to claim 1, in which the adhesive layer is formed of a thermo-activatable adhesive, and where the steps (iv) and (v) are implemented at a temperature below the activation temperature.

3. Method according to claim 1 or claim 2, in which the drying is an air drying or a vacuum drying.

4. Method according to claim 1 or claim 2, in which the adhesive layer is formed of a melted particular film-forming adhesive, and the application and drying temperature is above the temperature of formation of the film, but below the activation temperature.

5. Method according to claim 1 or claim 2, which further comprises a step of adjustment by abrasion of the first face of the moulding substrate.

6. Method according to claim 1 or claim 2, which moreover comprises a step of adjustment of the surface energy of the first face of the moulding substrate so as to adapt its degree of adherence.

7. Method according to claim 6, in which the adjustment of the surface energy is carried out according to one of the techniques comprised in the following group:

ionisation, treatment by plasma gun, corona treatment.

8. Method according to claim 1 or claim 2, which moreover comprises a step of preparation of the first face of the moulding substrate by machining or by moulding.

9. Method according to claim 1 or claim 2, which further comprises, subsequent to the step (vi), the following step:

printing the free surface of the article that is opposite to the adhesive layer in a printing machine.

10. Method according to claim 1 or claim 2, which moreover comprises, subsequent to the step (v), the following steps:

separating the moulding substrate from the article; and applying a peelable substrate in place of the moulding substrate.

11. Method of producing a sheet article, comprising for application of decorative layers on walls to be decorated, said method:

(i) feeding a machine with a substrate formed by an activatable adhesive film;

(ii) applying on a first face of the substrate a layer of material to be painted;

(iii) supplying a moulding substrate on the free surface of the layer of material to be painted opposite to the substrate before the drying of the layer of material to be painted;

(iv) drying the layer of material to be painted;

(v) separating the moulding from the assembly of the paint material layer and the activatable adhesive film; and (vi) performing again the method with the moulding substrate separated at step (v).

* * * * *